United States Patent [19]

Kofford

[11] 4,181,340

[45] Jan. 1, 1980

[54] LIFTING DEVICE FOR JAR LID ASSEMBLIES

[76] Inventor: Emanuel J. Kofford, 1905 Fillmore, Eugene, Oreg. 97405

[21] Appl. No.: 924,660

[22] Filed: Jul. 14, 1978

[51] Int. Cl.[2] ..... B66C 1/04

[52] U.S. Cl. ..... 294/65.5

[58] Field of Search ..... 294/65.52, 19 R, 2, 294/19 A, 23.5, 23, 22, 21, 20; 160/53, 138, 139, 140, 141; 336/293

[56] References Cited

U.S. PATENT DOCUMENTS

| | | | |
|---|---|---|---|
| 2,209,068 | 7/1940 | Blanchard | 294/23.5 |
| 3,384,408 | 5/1968 | Furzey | 294/65.5 |

*Primary Examiner*—James B. Marbert

*Attorney, Agent, or Firm*—James D. Givnan, Jr.

[57] ABSTRACT

A magnetic device for use by those engaged in home canning and useable for lifting of canning lids from boiling water in which the lids and rings have been sterilized. A heat resistant handle protects the user from injury.

2 Claims, 4 Drawing Figures

LIFTING DEVICE FOR JAR LID ASSEMBLIES

BACKGROUND OF THE INVENTION

The present invention concerns a household kitchen aid for use by a person doing home canning.

In home canning it is standard practice to sterilize lid assemblies prior to screwing them into place on the filled jar. Such sterilizing is usually accomplished by boiling of the lid and ring (constituting the lid assembly) in a pan on a stove element.

A problem exists in retrieving the circular lid assembly components from the boiling water as the lid components are difficult to lift with the usual kitchen tools.

SUMMARY OF THE PRESENT INVENTION

The present invention is embodied in a magnetic device with a heat resistant handle for retrieving lid components from a sterilizing bath of boiling water.

The device includes a magnetized body having a bottom wall adapted for surface contact with a submerged lid. The body is of a size to permit insertion, if desired, through the ring component of a lid assembly also for purposes of lifting same. The handle of the device is of a low heat conducting material such as wood or a suitable synthetic plastic so as to at all times be comfortable to grasping by the user. The magnetized body is centrally apertured for handle attachment purposes.

Important objectives of the invention include the provision of a lid retrieving device permitting the extraction of lids and rings from boiling water without risk to the user and the provision of a device having an elongate, heat resistant handle.

DETAILED DESCRIPTION OF THE PREFERRED EMBODIMENTS

Figure 1:
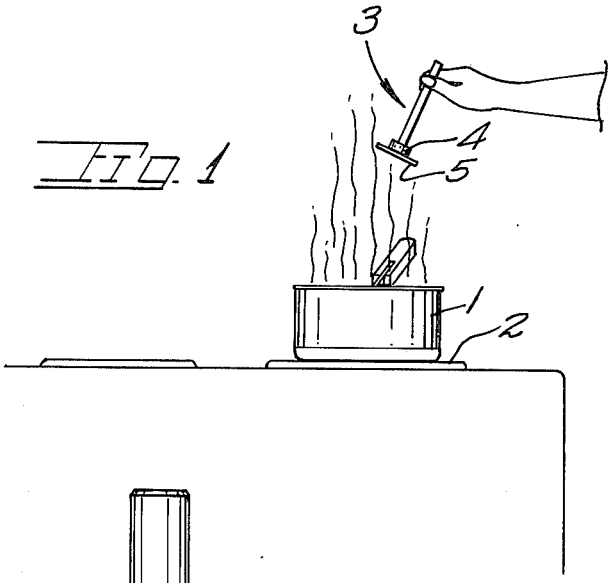
FIG. 1 is a side elevational view of the device in use.

With continuing attention to the drawing, the reference numeral 1 indicates a pan in place on a stove heating element 2 for the sterilizing of lid assemblies submerged within boiling water. Typically several lids and rings are sterilized at one time and left in the boiling water until installation on a filled jar.

The present device is indicated generally at 3 and includes a magnetized body 4. Body 4, which may be circuit disk shape, has a bottom surface 4A adapted for abutment with a metallic canning lid shown at 5. For purposes of avoiding rust, body 4 may be of a ceramic or refractory material having a magnetic capability.

A handle at 6 is preferably of wood by reason of being economical and low heat conductance, insulative characteristics. Body 4 is apertured at 4B to receive the handle end with securement being by a waterproof and heat resistant adhesive 7. The handle is of a length of several inches to permit lid pick-up without exposing the user's hand to burning steam.

Figure 4:
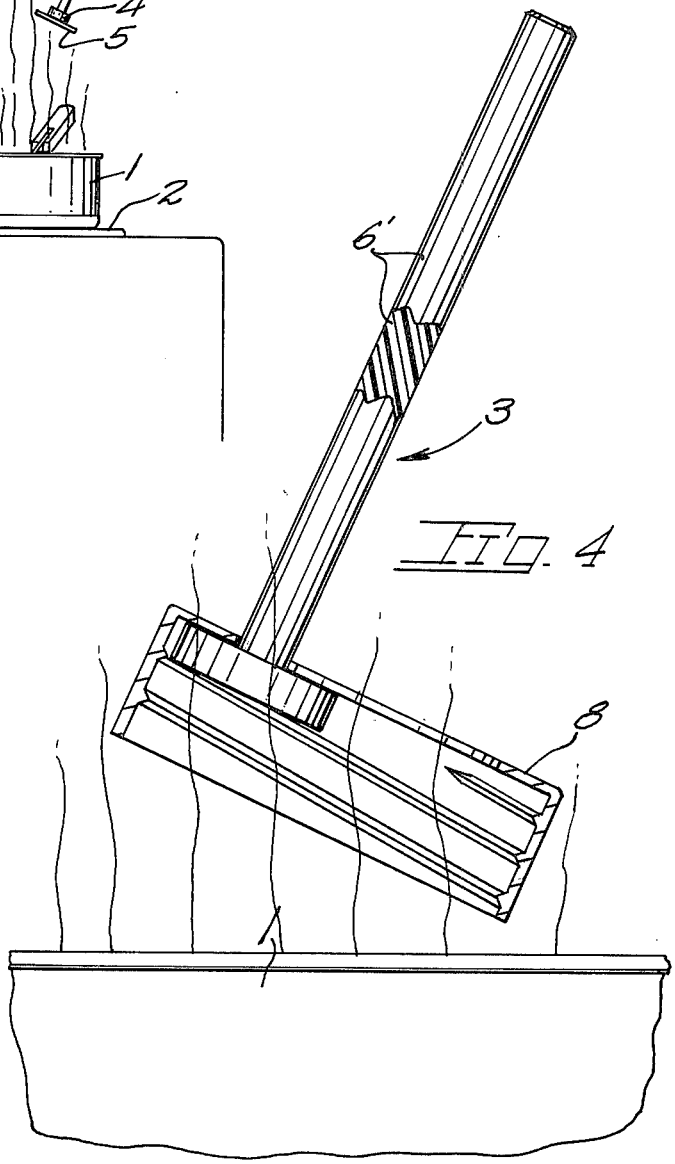
FIG. 4 is a side elevational view of the device in use lifting a ring of a lid assembly.
Figure 2:
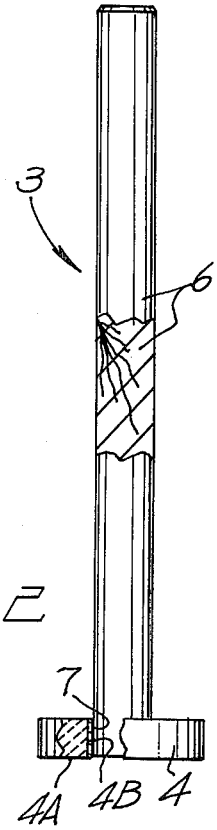
FIG. 2 is a side elevational view of the device.
Figure 3:
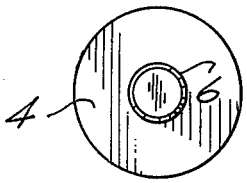
FIG. 3 is a top plan view of FIG. 2.

In FIG. 4 I show the lifting device inserted through the opening in the threaded ring 8 of a canning lid assembly and thereafter utilized to lift said ring. Lifting of the ring by the present device may be otherwise accomplished. Also in FIG. 4 the handle at 6′ is shown as being of a synthetic plastic of a heat resistant type.

While I have shown but a few embodiments of the invention it will be apparent to those skilled in the art that the invention may be embodied still otherwise without departing from the spirit and scope of the invention.

Having thus described the invention, what is claimed and desired to be secured under a Letters Patent is:

1. A device for lifting canning rings and lids from boiling water in which same are sterilized, said device comprising, a magnetic body defining a central aperture extending therethrough, an elongate handle of low heat conductance secured at one of its ends to said body within said aperture whereby said body may be submerged in boiling water to retrieve a lid or ring without risk of injury to the user.

2. The device claimed in claim 1 wherein said body is of disk configuration and of a size as to permit insertion through a canning ring and thereafter upwardly engage the underside of same for lifting of the ring.

* * * * *